US007960905B2

(12) United States Patent
Yamada et al.

(10) Patent No.: US 7,960,905 B2
(45) Date of Patent: Jun. 14, 2011

(54) DIAMOND ELECTRON SOURCE HAVING CARBON-TERMINATED STRUCTURE

(75) Inventors: Takatoshi Yamada, Ibaraki (JP); Christoph Nebel, Ibaraki (JP); Shinichi Shikata, Ibaraki (JP)

(73) Assignee: National Institute of Advanced Industrial Science and Technology, Tokyo (JP)

( * ) Notice: Subject to any disclaimer, the term of this patent is extended or adjusted under 35 U.S.C. 154(b) by 303 days.

(21) Appl. No.: 11/994,065

(22) PCT Filed: Jun. 21, 2006

(86) PCT No.: PCT/JP2006/312374

§ 371 (c)(1),
(2), (4) Date: Dec. 27, 2007

(87) PCT Pub. No.: WO2007/000919

PCT Pub. Date: Jan. 4, 2007

(65) Prior Publication Data

US 2009/0121614 A1 May 14, 2009

(30) Foreign Application Priority Data

Jun. 28, 2005 (JP) ..... 2005-188963
Jun. 8, 2006 (JP) ..... 2006-159249

(51) Int. Cl.
*H01J 1/00* (2006.01)

(52) U.S. Cl. ..... 313/311; 313/309; 313/310; 313/495

(58) Field of Classification Search ..... 313/495–497, 313/309–311; 445/50, 51
See application file for complete search history.

(56) References Cited

U.S. PATENT DOCUMENTS

| | | | | |
|---|---|---|---|---|
| 5,679,895 | A * | 10/1997 | von Windheim | 73/514.25 |
| 2004/0056580 | A1 * | 3/2004 | Nishibayashi et al. | 313/309 |
| 2004/0104406 | A1 * | 6/2004 | Derycke et al. | 257/200 |
| 2005/0202665 | A1 * | 9/2005 | Namba et al. | 438/607 |

FOREIGN PATENT DOCUMENTS

| | | |
|---|---|---|
| JP | 63 055197 | 3/1988 |
| JP | 7 065701 | 10/1995 |
| JP | 2002 203470 | 7/2002 |
| JP | 2003 109493 | 4/2003 |

* cited by examiner

*Primary Examiner* — Bumsuk Won
(74) *Attorney, Agent, or Firm* — Oblon, Spivak, McClelland, Maier & Neustadt, L.L.P.

(57) ABSTRACT

The present invention provides a diamond electron source exerting stable and excellent electron emission characteristics, which can be used for a cold cathode surface structure operable with low voltage and a method for producing the diamond electron source. Specifically, the diamond electron source having a carbon-terminated structure has a structure composed of an electrode and a diamond film and emits electrons or electron beams from the diamond film when voltage is applied to the electrode. The diamond film is made of diamond having a carbon-terminated structure. The method for producing the diamond electron source is also provided herein.

4 Claims, 7 Drawing Sheets

DIAMOND ELECTRON SOURCE HAVING CARBON-TERMINATED STRUCTURE

TECHNICAL FIELD

The diamond electron source having a carbon-terminated structure of the present invention can be used as an electron-beam-generating-apparatus in the fields involving various industrial instruments, household electrical appliances, and the like, such as flat panel displays, discharge tubes, lamps, excitation sources for X-rays, or ultraviolet rays, and vacuum micro/nano devices.

With the diamond electron source having a carbon-terminated structure according to the present invention, miniaturization and lower power consumption can be realized. In addition, such diamond electron source is an alternative to existing electron emission sources. Furthermore, development of such diamond electron source in new industrial fields is expected.

BACKGROUND ART

Various cold cathodes have been developed through microfabrication technology or thin-film formation technology. Applications of such cold cathodes for electron-beam-generating apparatuses including flat panel displays, discharge tubes, lamps, vacuum micro/nano devices, and the like has been studied. The realization of electronic devices, electronic instruments, and the like using properties of the cold cathodes, which is difficult in case of using solid state semiconductor devices, has been expected. Obtainment of a high current with low voltage is essential for the realization of such application. Accordingly, the applications of cold cathodes have been studied and developed from both material and structural viewpoints.

From the material viewpoint, materials with low work functions are promising, so that oxides such as zirconium oxide, nitrides such as titanium nitride and aluminum nitride, and carbon-based materials such as diamonds and diamond-like carbon are subjects of search and development. Meanwhile, formation of a sharp needle or a cone-shape structure is required for a cold cathode material such as conventionally known molybdenum or tungsten in order to efficiently obtain a high current with low voltage. Production with the use of nanotechnology that has recently remarkably progressed is also employed.

Diamond has a band gap that is as wide as 5.5 eV. However, the electron affinity on the surface is negative. Thus, diamond has been suggested as a good cold cathode material (see JP Patent Publication (Kokai) No. 2002-15658 A). Furthermore, aluminum nitride and boron nitride (which also have negative electron affinity) are similarly expected to be good cold cathode materials (see JP Patent Publication (Kokai) No. 2002-352694 A). Among these materials having such negative electron affinity, diamond is the most likely candidate, since diamond is excellent in terms of material synthesis and controllability, and because nanoprocessing technology for diamond has also been developed (see JP Patent Publication (Kokai) No. 10-312735 A (1998)). Also in terms of other physical properties including a high degree of hardness, thermal conductivity, and chemical stability, diamond is the best candidate as an electron emission material since diamond is a covalently-bound monoatomic material.

The negative electron affinity of diamond appears when a diamond surface is terminated with hydrogen, titanium, nickel, or the like. It has been reported that electron emission is observed with voltage lower than that of conventional metals or semiconductor materials through the use of such surface (see P. K. Baumann et al, Surface Science 409 (1998) 320). To use such surface feature, exciting or injecting electrons into a conduction band are necessary. Operation with low voltage is confirmed through addition of nitrogen or phosphorus, which is an impurity as a donor with a high concentration (see K. Okano et al, Nature 381 (1996) 140). However, electron emission that had actually elicited the feature of negative electron affinity was observed when the surface was terminated with cesium (see M. W. Geis et al, Applied Physics Letters 67 (1995) 1328). The use of caesium, which is handled with difficulty in terms of industrial application, is also problematic from an environmental viewpoint. Caesium has also high reactivity, so that the long-term stability thereof cannot be realized. Furthermore, negative electron affinity is also observed on a hydrogen-terminated surface. Specifically, the termination structure is stable in the air; however, it requires operation in an ultrahigh vacuum or hydrogen atmosphere from the viewpoint of stability of electron beam source operation. Such hydrogen-terminated surface has excellent basic characteristics, but is still problematic in terms of device operation.

DISCLOSURE OF THE INVENTION

Problems to be Solved by the Invention

Conventional materials have problems that operating voltage is high, that sufficient emission current is impossible to obtain compared with the case of hot cathodes, and that current is unstable. For diamond, which is particularly highly desirable because of its negative electron affinity, although operating voltage is reduced due to sharp tips, there is a problem to use high currents. This is because diamond requires sharpening of a tip for obtaining large currents, even when the operating voltage is reduced.

On a ground completely differing from conventional understandings, the present invention relates to a cold cathode surface structure capable of operating with low voltage, which actively uses the small positive electron affinity of diamond. The expression mechanism or operation mechanism of the negative electron affinity of hydrogen-terminated diamond surface is completely unknown. When the negative electron affinity surface is used as a cold cathode, such structure seems to be unstable. Actually, there exist almost no experimentally confirmed facts suggesting electron emission from the negative electron affinity surface of diamond.

The present inventors have discovered a structure to use the excellent physical properties and surface stability of diamond, and exerting excellent electron emission characteristics. Specifically, we have revealed that a carbon-terminated structure is stable like a re-constructed surface, and electron emission characteristics are observed at lower voltage than that in the case of a hydrogen-terminated surface having negative electron affinity. Regarding applications for electron sources, stabilization of electron emission currents is also an important factor for development, similar to operation with low voltage. Compared with other electron source materials, the emission current over time of hydrogen-terminated diamond is small. However, hydrogen-terminated diamond is problematic in that it has low durability against ion bombardment or the like. It has thus been revealed that stable electron emission can be obtained through production of the carbon-terminated structure of the present invention.

Means to Solve the Problems

The present inventors have conducted concentrated studies concerning these problems so as to devise the use of a structure that has remained unnoticed.

This relates to production of a diamond cold cathode that can be driven with low voltage. This means that significant reduction in electron emission voltage is enabled through the formation of neither conventional negative electron affinity nor hydrogen-terminated structure, but rather small positive electron affinity. Specifically, a low work function is produced with the stable carbon-terminated structure of a diamond surface.

Specific examples of techniques for carbon termination include, but are not limited to, heat treatment involving annealing or heat treatment that is performed at 500 K to 1500 K and more preferably at 900 K to 1400K in a high vacuum of $10^{-5}$ Torr or less or in an inert gas atmosphere such as nitrogen, argon, or helium. The surface of the present invention is ideally a reconstructed surface and may have any structure as long as the surface is entirely or partially terminated with carbon.

The present invention relates to a diamond electron source having a carbon-terminated structure, which is an electron source having a structure composed of an electrode and a diamond film and emitting electrons or electron beams from the diamond film when voltage is applied to the electrode, wherein the diamond film is made of diamond having a carbon-terminated structure.

Furthermore, according to the present invention, an impurity such as nitrogen, phosphorus, sulfur, or lithium can be added as a donor to diamond or an impurity element capable of forming an n-type or a composite thereof can be added to diamond. Preferably, such impurity is phosphorus capable of forming an n-type.

Furthermore, according to the present invention, a substrate can be a semiconductor or a metal.

Furthermore, according to the present invention, the diamond film can be obtained by CVD or a high-temperature high-pressure method.

Furthermore, according to the present invention, a diamond film can be a single crystal or epitaxial film having a (111)-, (100)-, or (100)-oriented crystal structure, or a polycrystalline film.

Furthermore, according to the present invention, a part of the surface of diamond is a carbon-terminated structure.

Furthermore, the present invention relates to a method for producing a diamond electron source having a carbon-terminated structure, comprising treating with heat a diamond film in a vacuum of $10^{-5}$ Torr or less at 500 K to 1500 K and more preferably 900 K to 1400 K, so as to eliminate hydrogen from the diamond surface and to obtain a carbon-terminated structure.

Furthermore, the present invention relates to a method for producing a diamond electron source having a carbon-terminated structure, comprising treating with heat a diamond film at 500 K to 1500 K and more preferably 900 K to 1400 K in an inert gas atmosphere of $10^{-1}$ Torr or less, such as Ar, nitrogen, or helium, so as to eliminate hydrogen from the diamond surface and to obtain a carbon-terminated structure.

EFFECT OF THE INVENTION

With the diamond film having a carbon-terminated surface structure of the present invention, a high current can be obtained with low voltage in an actual cold cathode operation. Therefore, according to the present invention, lower power consumption, miniaturization, and higher energy efficiency can be realized for conventional electronic instruments using electron beams.

Moreover, the present invention can also be applied to environmentally-resistant electronic devices, although the application to the same is difficult to realize by solid state semiconductor devices. Accordingly, such diamond film of the present invention can be a means for addressing future energy problems. The diamond film of the present invention is extremely effective industrially for use in electron-beam-generating apparatuses in fields involving various industrial instruments and household electrical appliances such as flat panel displays, discharge tubes, lamps, and vacuum micro/nano devices.

BEST MODE FOR CARRYING OUT THE INVENTION

Figure 1:
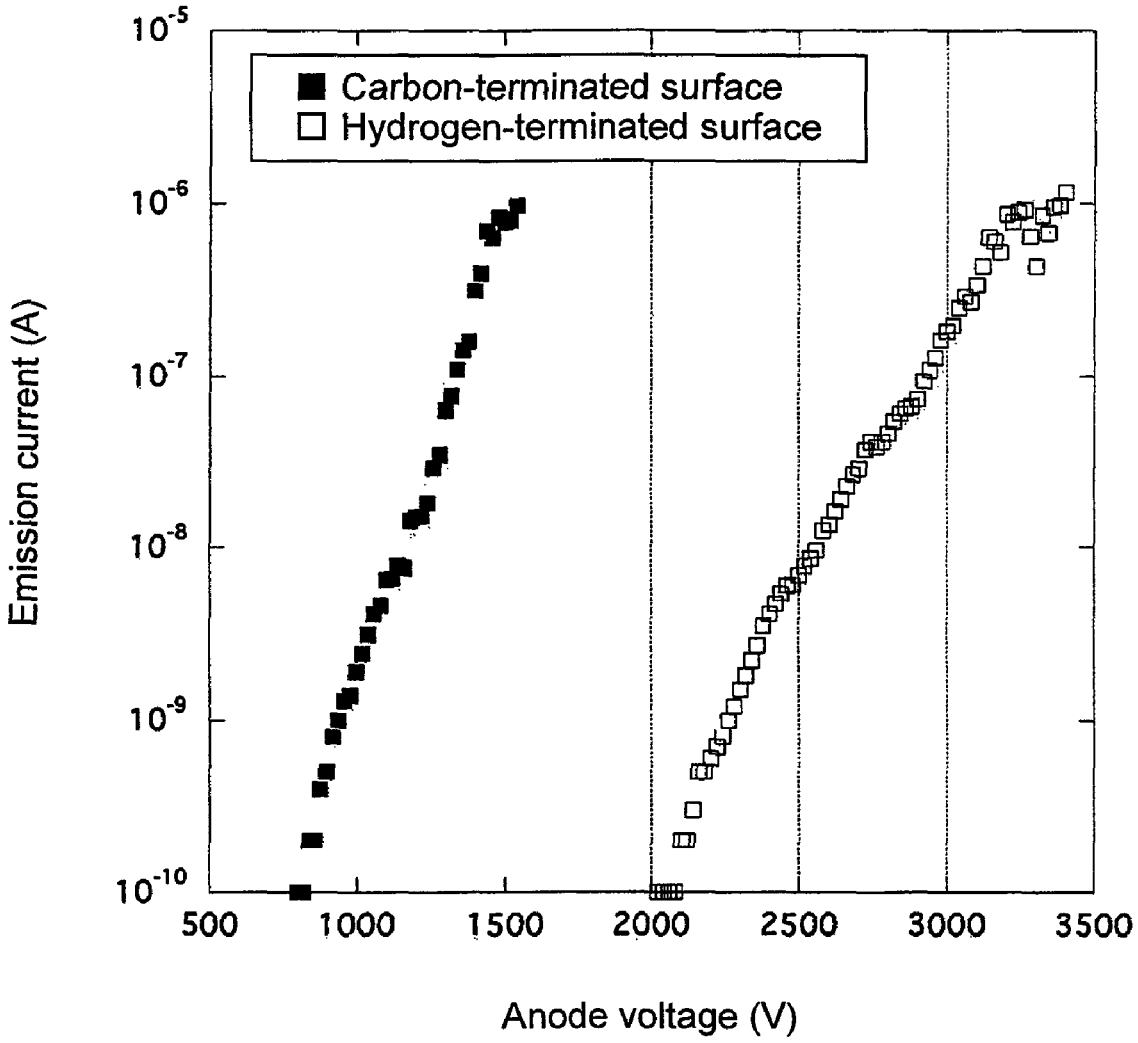
FIG. 1 is a characteristic graph of the present invention.

Utilization of small electron affinity of a carbon-terminated structure requires the formation of a high-density electronic state in a conduction band or in a level close to a vacuum level. Accordingly, diamond to which an impurity as a donor or an impurity capable of forming an n-type has been added is used. Furthermore, the higher the concentration of the electron or the impurity used herein, the easier initiation of electron emission with low voltage.

Diamond to be used for the carbon-terminated structure of the present invention is synthesized by a CVD method or obtained by a high-temperature high-pressure method. Both types of diamond can be formed by performing high-temperature heat treatment or annealing, so as to eliminate hydrogen, oxygen, or the other substances adsorbed on the diamond surface. Such high-temperature heat treatment can be performed in a high vacuum of $10^{-5}$ Torr or less or in an inert gas atmosphere of $10^{-1}$ Torr or less, such as Ar, nitrogen, or helium at 500 K to 1500K and more preferably at 900 K to 1400K.

Diamond to be used in the present invention is a phosphorus-doped homoepitaxial diamond thin film (111) with an electron concentration of $10^{17}$ $cm^{-3}$ or more. Furthermore, the diamond thin film is a phosphorus-doped homoepitaxial diamond thin film having resistivity of $10^{6}\Omega$ cm or less. Examples of an impurity to be added as a donor in the present invention include nitrogen, sulfur, lithium, and a composite thereof in addition to phosphorus. In view of controllability, phosphorus is a preferable impurity. Moreover, crystal plane orientation is not limited to (111) and the crystal plane orientation such as (100)-orientation can be used. A polycrystalline film can also be used. It is preferable to intentionally employ (111)-plane orientation characterized by high efficiency of incorporating an impurity.

A carbon-terminated structure can be formed by performing heat treatment in a high vacuum or in an inert gas atmosphere such as argon, nitrogen, or helium. A diamond film desired in the present invention has a structure that is completely terminated with carbon. However, a diamond film having a structure that is partially terminated with carbon may be able to sufficiently function.

EXAMPLE 1

A high-concentration phosphorus-doped homoepitaxial diamond thin film (111) was synthesized so that the concentration of phosphorus was 1% with respect to carbon within a reaction tank upon synthesis, and the same was then used as a sample. The diamond film was synthesized by a microwave CVD method in an atmosphere of gases (methane and hydrogen) using phosphine as a source for addition of phosphorus. Synthesis conditions employed herein consisted of a ratio of methane to hydrogen of 5:100 and a ratio of phosphine to methane of 1:100. Ib(111) synthesized via high temperature and high pressure was used as a substrate.

A diamond film used herein exerted an n-type electrical conducting property as confirmed by Hall effect measurement, and it had an electron concentration at room temperature between $10^{17}$ $cm^{-3}$ and $10^{19}$ $cm^{-3}$ and a resistivity between $10^2$ Ωcm and $10^4$ Ωcm.

A carbon-terminated structure was formed by 1 hour of heat treatment at 900° C. in a high vacuum of $1\times10^{-9}$ Torr or less.

Electron emission characteristics were measured in a vacuum of $1\times10^{-9}$ Torr. Each sample was fixed on a ground electrode and then hemispherically-processed tungsten having a diameter of 20 μm was used as an anode. The distance between the anode and the diamond surface was determined to be 50 μm. The voltage of the anode electrode was increased and the thus observed emission current was measured. Regarding electron emission characteristics, whereas the surface of the hydrogen-terminated structure (which was a negative electron affinity surface obtained from the same sample) initiated electron emission with 2000 V, electron emission was initiated in the case of this sample with 800 V. It could thus be confirmed that the voltage for initiation of electron emission could be reduced to 800 V, or approximately one-third of that in the other case (FIG. 1).

EXAMPLE 2

A high-concentration phosphorus-doped homoepitaxial diamond thin film (111) was synthesized so that a ratio of phosphine to methane was 1:100 and then used as a sample.

Heat treatment was performed in an Ar atmosphere of approximately $1\times10^{-2}$ Torr at 800° C. for 1 hour. Regarding electron emission characteristics, the electron emission initiation voltage was confirmed to be at the same level as that of a vacuum-annealed surface.

Figure 2:
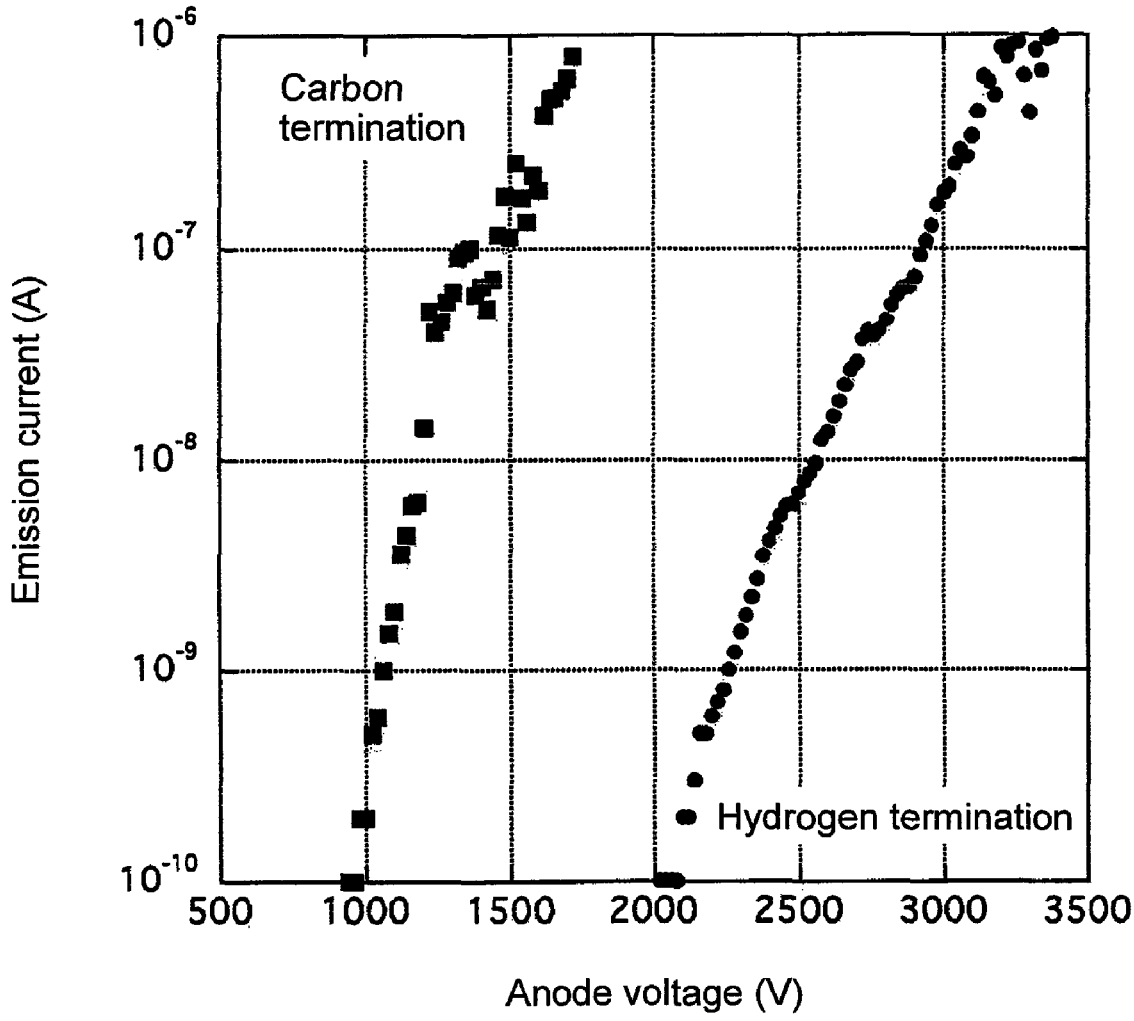
FIG. 2 is a characteristic graph of the present invention.

Electron emission characteristics were measured in a vacuum of $1\times10^{-9}$ Torr. Each sample was fixed on a ground electrode and then hemispherically-processed tungsten having a diameter of 20 μm was used as an anode. Distance between the anode and the diamond surface was determined to be 50 μm. The voltage of the anode electrode was increased and the thus observed emission current was measured. Regarding electron emission characteristics, whereas the surface of the hydrogen-terminated structure (that was a negative electron affinity surface obtained from the same sample) initiated electron emission with 2000 V, electron emission was initiated with 1000 V in the case of this sample. It could thus be confirmed that the voltage for initiation of electron emission could be reduced to 1000 V, or approximately a half of that in the other case. FIG. 2 shows the result.

EXAMPLE 3

A high-concentration phosphorus-doped homoepitaxial diamond thin film (111) was synthesized so that a ratio of phosphine to methane was 1:100 and then used as a sample. A carbon-terminated structure was formed by 1 hour of heat treatment at 800° C. in a high vacuum of $1\times10^{-9}$ Torr or less.

In a vacuum of $1\times10^{-9}$ Torr, changes over time in electron emission characteristics when certain voltage had been applied were measured.

Figure 5:
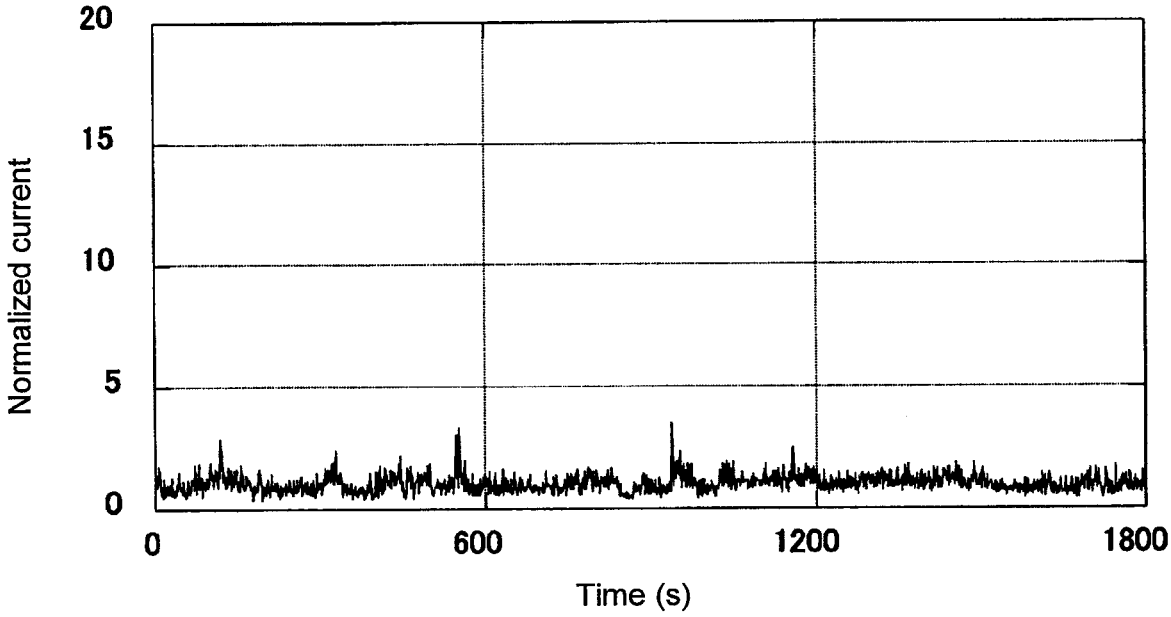
FIG. 5 is a characteristic graph (changes over time, normalized with initial current <Example 3>) of the present invention.
Figure 6:
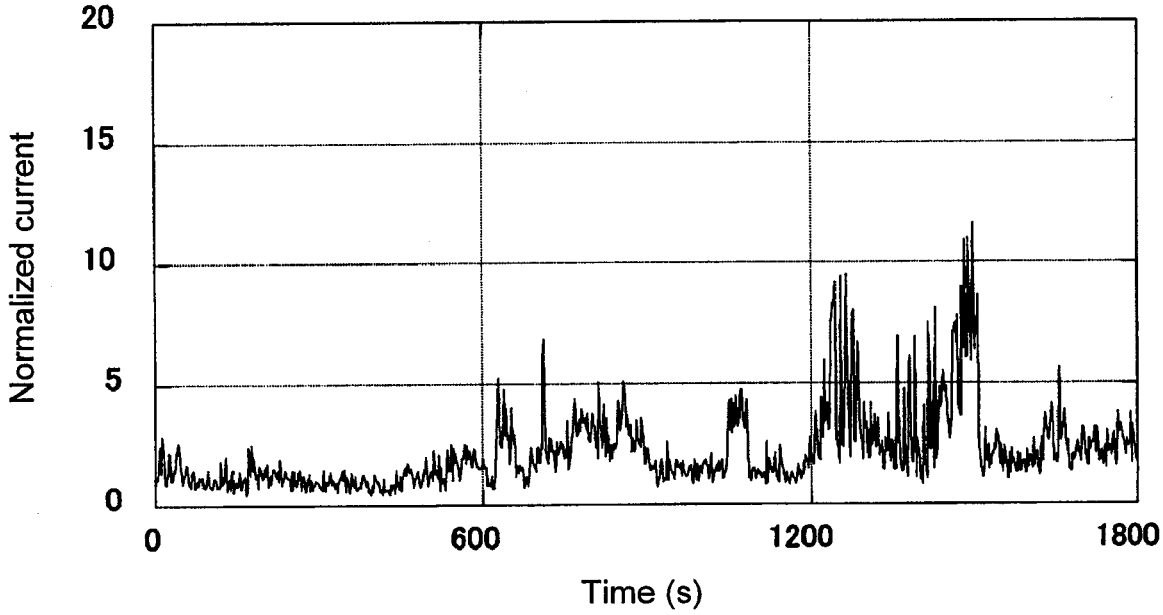
FIG. 6 is a characteristic graph (hydrogen-terminated surface) of conventional examples.

FIG. 5 shows changes over time, which had been normalized with initial current. A hydrogen-terminated surface showed changes within a range between 0.01 and 50 compared with the initial current (FIG. 6). However, the carbon-terminated surface of the present invention showed changes within a range between 0.5 and 2.5.

In these Examples, electron emission initiation voltage significantly lower than that achieved by conventional technology using negative electron affinity or nanotechnology as in the following Comparative examples could be realized.

COMPARATIVE EXAMPLE 1

The surface of the present invention was compared with a hydrogen-terminated diamond surface having negative electron affinity, to which phosphorus had been added at a high concentration, having the lowest electron emission initiation voltage among those achieved according to conventional technology. The same samples were used to facilitate comparison.

A high-concentration phosphorus-doped homoepitaxial diamond thin film (111) was synthesized so that the concentration of phosphorus was 1% with respect to carbon within a reaction tank upon synthesis and then used as a diamond to which phosphorus had been added at a high concentration. A hydrogen-terminated structure was formed by hydrogen plasma treatment using microwave excitation and an apparatus for diamond synthesis. Representative conditions were composed of pressure of 80 Torr, substrate temperature of 800° C., and a time of 10 minutes.

Figure 3:
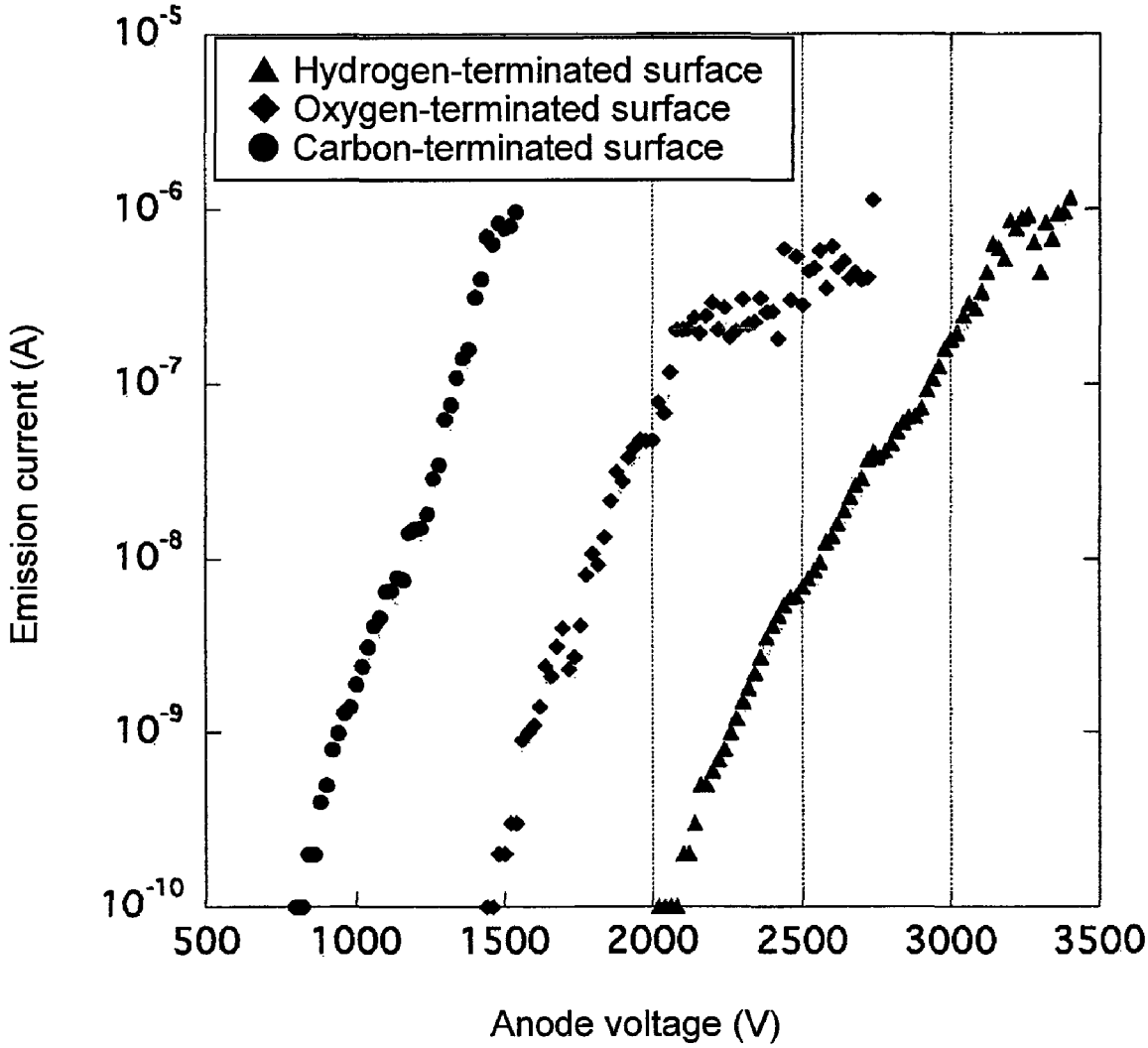
FIG. 3 is a characteristic graph for comparison with conventional examples.

Electron emission characteristics were measured in a vacuum of $1\times10^{-9}$ Torr. Each sample was fixed on a ground electrode and then hemispherically-processed tungsten having a diameter of 20 μm was used as an anode. Distance between the anode and the diamond surface was determined to be 50 μm. The voltage of the anode electrode was increased and the thus observed emission current was measured. Regarding electron emission characteristics, the surface of the hydrogen-terminated structure (that was a negative electron affinity surface obtained from the same sample) initiated electron emission with 2000 V (FIG. 3).

COMPARATIVE EXAMPLE 2

Figure 4:
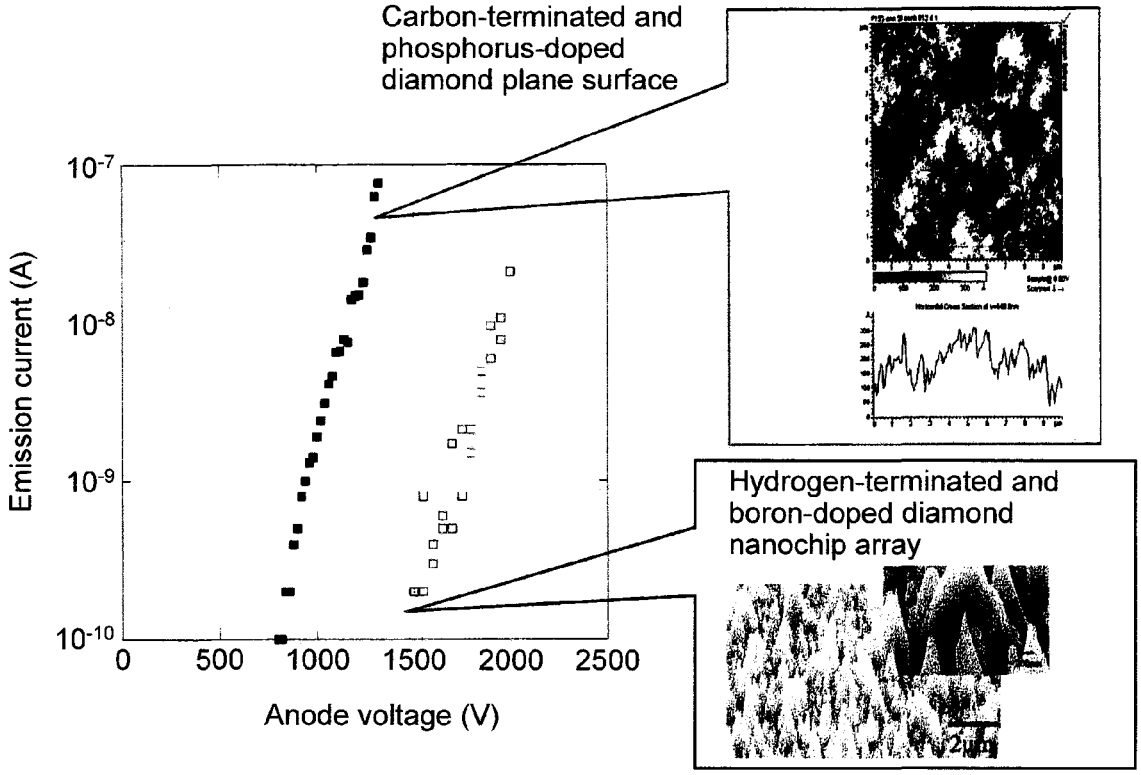
FIG. 4 is a characteristic graph for comparison with conventional examples.

It is known that p-type semiconductor diamond surface has low electron emission initiation voltage as in reported examples of electron emission from diamond. Furthermore, the surface of the present invention was compared with a p-type diamond semiconductor nanowhisker hydrogen-terminated structure that exerts excellent properties from material and structural viewpoints through formation of a nanostructure as in the case of a conventional silicon or metal cold cathode (FIG. 4).

The nanostructure was formed by plasma etching and then the hydrogen-terminated structure was formed on the nanostructure using a hot filament CVD apparatus for diamond synthesis. Representative conditions consisted of filament temperature of 2100° C., substrate temperature of 800° C., hydrogen atmosphere pressure of 100 Torr, and a time of 10 minutes.

Electron emission characteristics were measured in a vacuum of $1\times10^{-9}$ Torr. Each sample was fixed on a ground electrode and then hemispherically-processed tungsten having a diameter of 20 μm was used as an anode. Distance between the anode and the diamond surface was determined to be 50 μm. The voltage of the anode electrode was increased and the thus observed emission current was measured. Regarding electron emission characteristics, the surface having the hydrogen-terminated structure (that was a negative electron affinity surface obtained from the same sample) initiated electron emission with 1500 V (FIG. 4).

COMPARATIVE EXAMPLE 3

The surface of the present invention was compared with an oxygen-terminated diamond surface having negative electron affinity to which phosphorus had been added at a high concentration and for which electron emission with low voltage had been observed according to conventional technology. The same samples were used to facilitate comparison.

A high-concentration phosphorus-doped homoepitaxial diamond thin film (111) was synthesized so that the concentration of phosphorus was 1% with respect to carbon within a reaction tank upon synthesis and then used as the diamond to which phosphorus had been added at a high concentration. A carbon-terminated structure was formed by performing 1 hour of heat treatment at 900° C. in a high vacuum of $1\times10^{-9}$ Torr or less. An oxygen-terminated structure was formed by boiling in a solution prepared by mixing nitric acid with sulfuric acid at 1:3 within a temperature ranging from 100° C. to 200° C. For the thus formed carbon-terminated structure, electron emission characteristics were measured in a vacuum of $1\times10^{-9}$ Torr.

Each sample was fixed on a ground electrode and then hemispherically-processed tungsten having a diameter of 20 μm was used as an anode. Distance between the anode and the diamond surface was determined to be 50 μm. The voltage of the anode electrode was increased and the thus observed emission current was measured. Regarding electron emission characteristics, the surface having the oxygen-terminated structure (that was a positive electron affinity surface obtained from the same sample) initiated electron emission with approximately 1500 V (FIG. 3).

Electron emission was observed with low voltage. Changes over time in electron emission from the relatively stable oxygen-terminated structure were measured.

A high-concentration phosphorus-doped homoepitaxial diamond thin film (111) was synthesized so that the concentration of phosphorus was 1% with respect to carbon within a reaction tank upon synthesis and then used as diamond to which phosphorus had been added at a high concentration. An oxygen-terminated structure was formed by boiling in a solution prepared by mixing nitric acid with sulfuric acid at 1:3 at a temperature ranging from 100° C. to 200° C. A carbon-terminated structure was formed by 1 hour of heat treatment at 800° C. in a vacuum of approximately $1\times10^{-9}$ Torr.

Fluctuation over time in electron emission characteristics when certain voltage was applied in a vacuum of $1\times10^{-9}$ Torr was measured.

Figure 7:
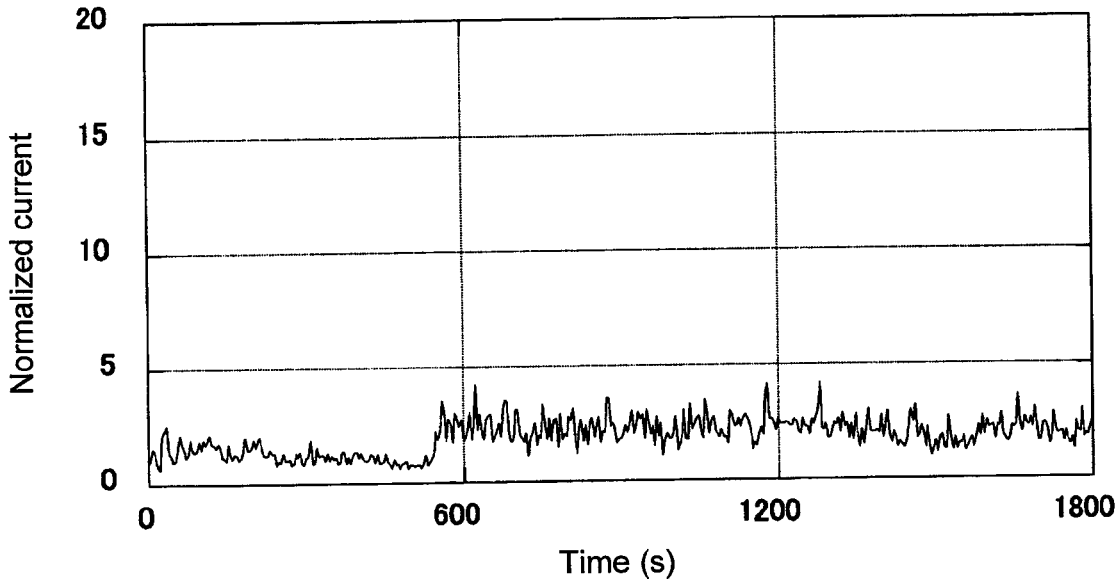
FIG. 7 is a characteristic graph (changes over time, normalized with initial current <Comparative example 3>).

FIG. 5 shows fluctuation over time, which have been normalized with initial current. The oxygen-terminated surface showed changes within a range between 0.6 and 10 based on initial current. Thus, increases in the current level of the oxygen-terminated surface were confirmed. In contrast, the carbon-terminated surface of the present invention showed fluctuation within a range between 0.5 and 2.5 so that the stable electron emission therefrom could be confirmed (FIG. 7).

INDUSTRIAL APPLICABILITY

The carbon-terminated structure of the present invention has a planar structure compared with the nanostructure diamond with which electron emission with low voltage has been realized. Hence, the carbon-terminated structure has a structure suitable for obtainment of larger currents. Moreover, electron emission initiation voltage in the case of the carbon-terminated structure is significantly lower than that in the case of a negative electron affinity surface. Accordingly, it is predicted that the carbon-terminated structure has a narrow angle of radiation of electron beams and a narrow energy width of emitted electrons. This means the carbon-terminated structure is excellent for use in displays such as field emission displays. Furthermore, the use of the carbon-terminated structure can be developed for use for analysis and evaluation apparatuses using electron beams, such as electron microscopes. Compared with conventional apparatuses, such analysis and evaluation apparatuses for which the carbon-terminated structure is applied have higher accuracy, so that novel development and discovery can be expected in terms of analyses and evaluation.

The invention claimed is:

1. A diamond electron source having a carbon-terminated structure, which comprises a substrate provided with an electrode and a diamond film and emits an electron beam from the diamond film when voltage is applied to the electrode, wherein the diamond film:

is a single crystal or epitaxial film having a (111)-oriented crystal structure or a polycrystalline film;

is made of diamond having a carbon-terminated structure, which is obtained by treating a diamond film with heat in a vacuum of $10^{-5}$ Torr or less or an inert gas atmosphere of $10^{-1}$ Torr or less at 800° C. to 900° C.; and is prepared by adding phosphorus, which is an impurity capable of forming an n-type.

2. The diamond electron source having a carbon-terminated structure according to claim 1, wherein the substrate is a semiconductor or a metal.

3. The diamond electron source having a carbon-terminated structure according to claim 1, wherein the diamond film is obtained by a CVD method or a high-temperature, high-pressure method.

4. The diamond electron source having a carbon-terminated structure according to claim 1, wherein a surface part of the diamond film has a carbon-terminated structure.

* * * * *